US009259943B2

(12) United States Patent
Veis et al.

(10) Patent No.: US 9,259,943 B2
(45) Date of Patent: Feb. 16, 2016

(54) METHOD AND APPARATUS FOR CURING INK

(71) Applicant: Hewlett-Packard Industrial Printing Ltd., Netanya (IL)

(72) Inventors: Alex Veis, Netanya (IL); Ran Vilk, Netanya (IL); Gilhad Ben-Bassat, Netanya (IL); Yochai Edlitz, Netanya (IL)

(73) Assignee: Hewlett-Packard Industrial Printing LTD., Netanya (IL)

( * ) Notice: Subject to any disclaimer, the term of this patent is extended or adjusted under 35 U.S.C. 154(b) by 0 days.

(21) Appl. No.: 14/754,281

(22) Filed: Jun. 29, 2015

(65) Prior Publication Data

US 2015/0298466 A1 Oct. 22, 2015

Related U.S. Application Data

(63) Continuation of application No. 14/350,789, filed as application No. PCT/IL2011/000804 on Oct. 11, 2011, now Pat. No. 9,102,171.

(51) Int. Cl.

| | |
|---|---|
| ***B41J 2/01*** | (2006.01) |
| ***B41J 11/00*** | (2006.01) |
| *B41J 11/20* | (2006.01) |
| *B41J 19/00* | (2006.01) |

(52) U.S. Cl.

CPC ..... *B41J 11/002* (2013.01); *B41J 11/0035* (2013.01); *B41J 11/20* (2013.01); *B41J 19/00* (2013.01)

(58) Field of Classification Search

None

See application file for complete search history.

(56) References Cited

U.S. PATENT DOCUMENTS

| | | | | |
|---|---|---|---|---|
| 7,837,319 | B2 | 11/2010 | Rodin et al. | |
| 7,891,802 | B2 | 2/2011 | Gouch | |
| 2007/0139504 | A1 | 6/2007 | Siegel | |
| 2009/0207223 | A1 | 8/2009 | Cofler et al. | |
| 2010/0259589 | A1 | 10/2010 | Barry et al. | |
| 2013/0113868 | A1 * | 5/2013 | Veis | B41J 11/0015 347/102 |

FOREIGN PATENT DOCUMENTS

| | | | |
|---|---|---|---|
| EP | 2335940 | A1 | 6/2011 |
| JP | 2003285423 | A | 10/2003 |
| JP | 2011051299 | A | 3/2011 |
| WO | WO-2010150023 | A2 | 12/2010 |

OTHER PUBLICATIONS

International Searching Authority, International Search Report and Written Opinion, PCT/IL2011/000804, 10 pages, Jan. 31, 2012.

* cited by examiner

*Primary Examiner* — Lisa M Solomon

(57) ABSTRACT

According to one example there is provided apparatus for curing ink on a substrate. The apparatus comprises a substrate support, a curing sheet positionable above the substrate support to create a gap between a substrate on the substrate support and the curing sheet. The apparatus further comprises an oxygen-depletion mechanism for reducing the oxygen level in the gap and an ultra-violet, UV, radiation source to apply UV radiation through the curing sheet to a substrate on the substrate support.

15 Claims, 4 Drawing Sheets

METHOD AND APPARATUS FOR CURING INK

PRIORITY

This application is a Continuation of commonly assigned and co-pending U.S. patent application Ser. No. 14/350,789, having a filing date of Apr. 9, 2014, which claims priority to PCT Application Serial Number PCT/IL2011/000804, having an international filing date of Oct. 11, 2011, the disclosures of which are hereby incorporated by reference in their entireties.

BACKGROUND

The use of ultra-violet (UV) curable inks is well known within the printing industry, particularly in so-called industrial printing. UV curable inks are often used, for example, for prints which may be exposed to water, such as in outdoor environments. UV curable inks (herein after generally referred to as simply UV inks) typically exhibit enhanced water-resistance and durability compared to water-based inks.

In incremental printing systems, such as inkjet printing systems, it is known to include UV radiation sources in proximity to the inkjet writing system to cure UV ink once it has been printed on a media. Such systems are generally said to perform in-line curing. However, such systems require considerable amounts of electrical power to drive the UV radiation sources. For example, some industrial printers may have to use dedicated power lines in order to provide the necessary electrical power for performing curing.

As the speed of industrial printers is generally increasing, so the amount of power necessary to cure UV ink has to increase to provide curing in an ever smaller amount of time.

UV radiation sources, such as arc UV lamps, generate significant amounts of heat during operation, thus the use of such radiation sources further complicates printer design as the heat must be managed and/or removed so as to not have negative consequences on print quality or printer reliability.

In order to reduce the amount of power required to cure UV inks it is known to performing curing in an oxygen-depleted environment. Such an approach can, in some instances, enable UV inks to be cured with 20% less power compared to performing curing in an oxygen-rich environment.

However, providing an oxygen-depleted atmosphere within a printer is particularly challenging and may have significant complexity and cost impacts, not to mention potential safety concerns for printer operators.

BRIEF DESCRIPTION

Examples (or embodiments) of the invention will now be described, by way of non-limiting example only, with reference to the accompanying drawings, in which.

Figure 4A:
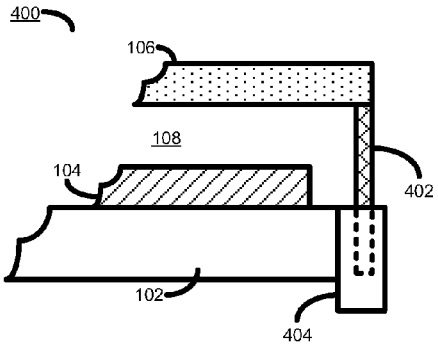
Figure 5A:
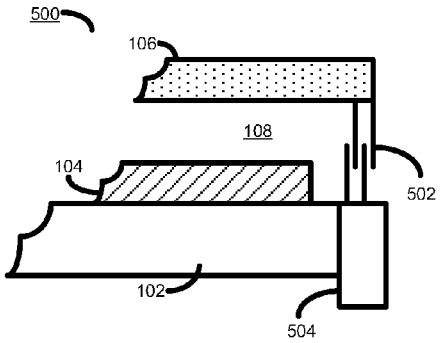
Figure 4B:
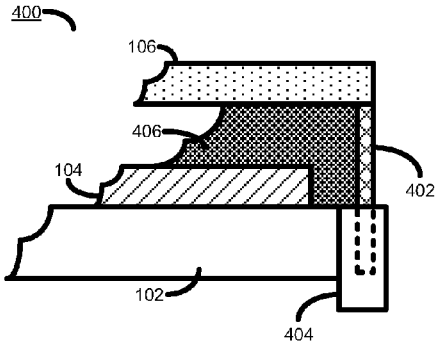
Figure 5B:
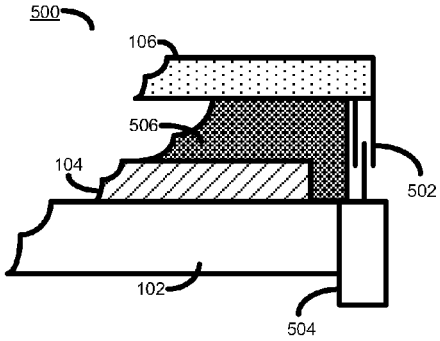
Figure 6:
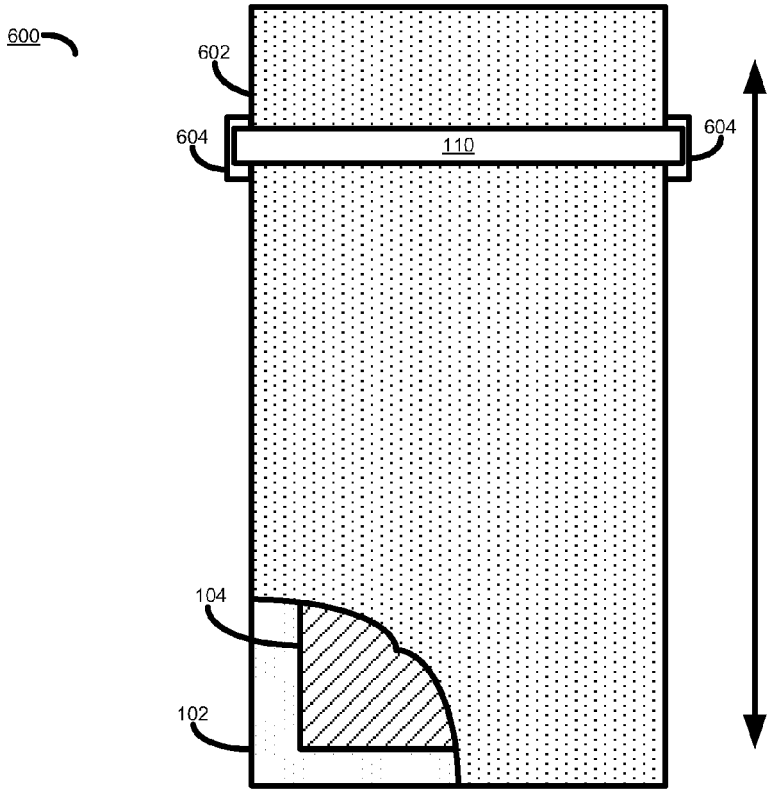
Figure 7:
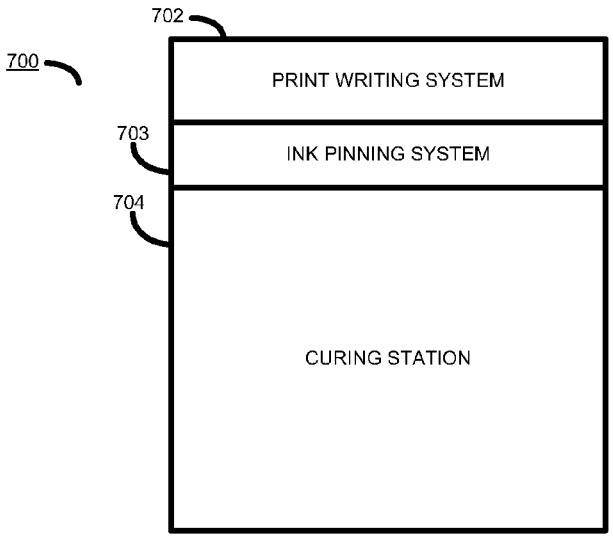

FIG. 4*a* is a simplified section view of a section of a curing station according to one example;

FIG. 4*b* is a simplified section view of a section of a curing station according to one example;

FIG. 5*a* is a simplified section view of a section of a curing station according to one example;

FIG. 5*b* is a simplified section view of a section of a curing station according to one example;

FIG. 6 is a simplified plan view of a curing station according to one example; and FIG. 7 is a simplified plan view of a combined printing system and curing station according to one example.

DETAILED DESCRIPTION

Figure 1:
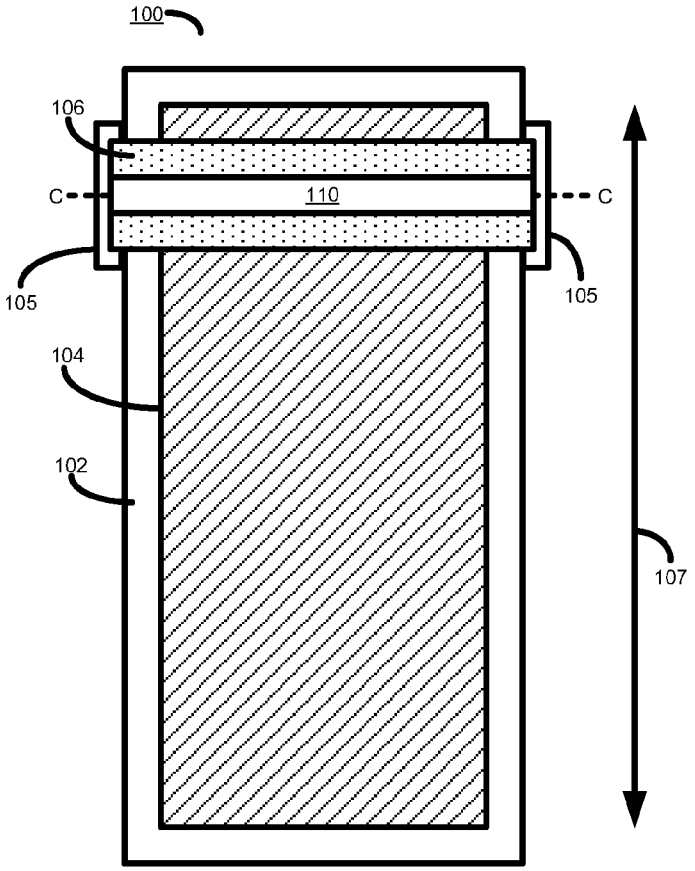
FIG. 1 is a simplified plan view of a curing station according to one example.
Figure 2:
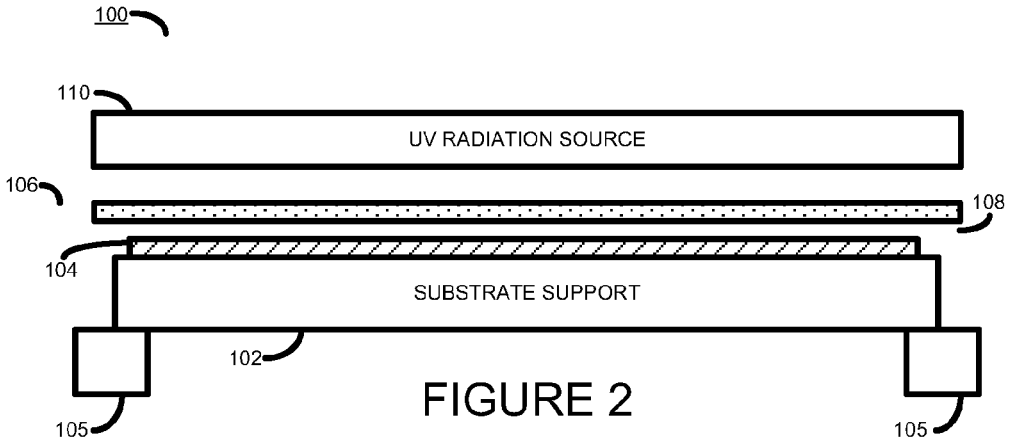
FIG. 2 is a simplified section view of the curing station of FIG. 1 according to one example.

Referring now to FIG. 1 there is shown a simplified plan view of an ink curing station 100 according to one example. FIG. 2 shows a simplified section view of the curing station 100 of FIG. 1 at the section C-C.

The curing station 100 comprises a substrate support 102 for receiving and supporting a substrate 104. The substrate 104 may be any suitable substrate, such as a flexible substrate, a semi-rigid substrate, a rigid substrate, or the like, onto which ink from a printing system is deposited. The ink deposited on the substrate may be an ink that requires curing, such as a UV curable ink.

In one example, the curing station 100 is independent from any printing system. In another example, the curing station 100 is incorporated into a printing system.

To reduce the amount of UV radiation required to cure ink on the substrate 104, and to hence reduce the amount of electrical energy to cure the ink, the curing station 100 uses an oxygen-depletion mechanism to deplete or reduce the amount of oxygen in contact with the ink on the substrate 104 prior to applying UV radiation to the ink.

To facilitate the provision of an oxygen-depleted atmosphere the ink curing station 100 includes a curing plate 106. The curing plate 106 may be made, for example, of any suitable material that is substantially transparent to UV light. Suitable materials may include, for example, quartz, and fused silica. In one example the curing plate 106 is a rigid plate. In another example the curing plate 106 is a semi-rigid plate or a flexible sheet.

The curing plate 106 is positioned above the top surface of substrate 104, and in close proximity thereto, to form a gap or void 108. The height of the void 108 may, in one example, be in the range of about 2 mm to 2 cm. In other examples, however, other void heights may be used.

In one example the curing plate 106 is mounted on a height adjustable support mechanism, thereby allowing the height of the void 108 to be adjustable. In one example, the height of the curing plate 106 relative to the surface of the substrate may be automatically adjustable, for example using one or more height or proximity detectors (not shown). The height of the curing plate may be adjusted, for example, by one or multiple motors, servos, pistons, or the like.

Once suitably positioned, the void 108 may be flooded or substantially filled with an inert gas, such as nitrogen, thereby leading to the creation of an oxygen-depleted atmosphere in contact with the substrate 104 (and any ink thereon). The flooding of the void 108 with an inert gas may be achieved, for example, by way of one or multiple gas injectors (not shown) being positioned at one or multiple locations in proximity to the edge of the curing plate 106. The gas injectors serve to inject an inert gas under pressure from a controllable gas supply (not shown), such that the oxygen level in the void 108 is reduced.

In one example, one or multiple gas injectors may be positioned in proximity to one edge of the curing plate 106, thereby causing an inert gas to be blown across the void, thereby leading to an oxygen-depleted atmosphere in the void. In another example, one or multiple gas injectors may be positioned in proximity to two opposing edges of the curing plate 106, thereby causing an inert gas to be blown into the void. In a further example, one or multiple gas injectors may be positioned in proximity to each of the edges of the curing plate 106.

Once the air in the void 106 has been depleted in oxygen to a suitable level, a UV radiation source 110 emits UV radiation through the curing plate 106, thereby curing any ink on the substrate 104. In one example, the oxygen level in the void 106 is reduced to below about 10%. In other examples, different oxygen levels may be attained.

The zone of the substrate 104 able to be cured at any one time is referred to herein as the curing zone. The size of the curing zone may depend, for example, on the power, size, the direction, etc. of the UV radiation source 110, as well as the size of the oxygen-depleted atmosphere formed between the curing plate 106 and the substrate 104.

In the present example the curing plate 106 and UV radiation source 110 span substantially the width of the substrate support 102, but only cover a portion of the length of the substrate support 102. Accordingly, the curing plate 106 and UV radiation source 110 are mounted on a movable carriage 105 to enable the curing zone to be moved, as shown by arrow 107, along the length of the substrate support 102, thereby enabling ink on the whole of the substrate 104 to be cured in an incremental manner.

In one example, operation of the curing station 100 is controlled by a curing station controller (not shown). The curing station controller may be implemented, for example, using one or more logic circuits, a microprocessor, discrete electronic components, or the like.

Figure 3:
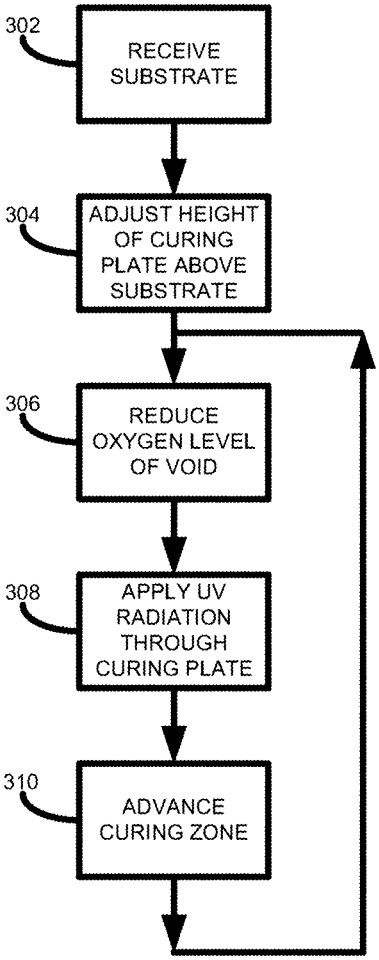
FIG. 3 is a flow diagram outlining a method of operating a curing station according to one example.

Operation of the curing station 100, according to one example, will now be described with reference to the flow diagram of FIG. 3.

At 302 a substrate 104 having ink to be cured is received at the curing station 100. At 304 the curing station controller adjusts the height of the curing plate 106 above the substrate 304 such that a void 108 of a predetermined height is created between the top surface of the substrate and the lower surface of the curing plate 106.

At 306 the curing station controller reduces the oxygen level of the void 108 by introducing an inert gas under pressure into the void 108. The amount of inert gas introduced into the void 108 may be estimated, for example, based on the dimensions of the curing plate 106 and the height of the void 108.

Once the oxygen level of the void has been sufficiently reduced, the controller controls (308) the UV radiation source 110 to emit UV radiation through the curing plate 106. At 310 the controller advances the carriage 105 on which the curing plate 106 and UV radiation source 110 is mounted along the length of the substrate 104, to thereby cure ink on the whole of the substrate 104.

In one example, the controller reduces the oxygen level in the curing zone to an acceptable level by introducing inert gas into the void 108 at a predetermined rate. Before curing is started, a delay may be introduced after inert gas is first introduced into the void 108 and prior to the UV radiation source 110 being activated, after which time it may be assumed that the oxygen level of the void 108 is at an acceptable level for curing to occur.

In one example, inert gas is continually introduced into the void 108 as the carriage 105 is advanced, thereby ensuring that the curing zone has a sufficiently oxygen-depleted atmosphere. The amount of UV radiation emitted by the UV radiation source 110, and hence the power of the UV radiation source, may be estimated based on the nature of the UV ink to be cured and the estimated or assumed oxygen-depletion level of the void 308.

In the present example, the void 108 is substantially open to the atmosphere, thereby allowing inert gas introduced therein to leak into the atmosphere. However, with a sufficient flow of inert gas into the void, the oxygen level of the void may be maintained at a satisfactorily oxygen-depleted level for curing to take place.

Referring now to FIG. 4*a* there is shown a close-up of part of a curing station 400 according to a further example. The curing station 400 has a curing plate wall 402 that extends from the curing plate 106 and supports the curing plate on a movable carriage mechanism 404. The curing plate wall 402 is extendable into a recess in the carriage mechanism 404, such that the curing plate 106 is height adjustable. A suitable seal, such as a gasket or joint, may be included between the curing plate wall 402 and the carriage mechanism 404 to provide a good seal. It should be noted, however, that the two traversal edges of the curing plate 106 are not sealed against the substrate 104.

Referring now to FIG. 5*a* there is shown a close-up of part of a curing station 500 according to a further example. The curing station 400 has curing plate wall 502 that extends from the curing plate 106 and supports the curing plate on a movable carriage mechanism 504. The curing plate wall 502 comprises a plurality of vertically extending interleaving fins 502. The fins 502 enable the curing plate 106 to be height adjustable. The fins may be covered, for example, with bristles or other material, to enable a reasonable seal. It should be noted again, however, that the two traversal edges of the curing plate 106 are not sealed against the substrate 104.

In a one example, one or both of the open traversal sides of the curing plate 106 includes a wall that descends towards, but does not make contact with, a substrate 104 on the substrate support 104. The base of the wall may be closer to the substrate 104 than the curing plate 106, thereby helping to contain inert gas introduced into the void 108.

In a further example, as illustrated in FIGS. 4*b* and 5*b*, the traversal edge of the curing plate 106 that extends above ink that has been cured includes a wall (406, 506) that descends towards the substrate support 104. The wall may be made of a light, flexible material, such as silicon, that may contact cured ink on the substrate and forms a seal, or at least a partial seal, or at least substantially closes that edge of the curing plate 106 to the atmosphere. The wall material is such that no damage is done to either the ink or the substrate as the curing plate 106 is moved along the length of the substrate support 102.

In one example, the substrate 104 received in the curing station has UV ink that has previously been partially cured, or 'pinned'. Ink pinning is beneficial in that the amount of UV radiation needed to pin a UV ink is substantially less than the amount of UV radiation needed to cure a UV ink. Consequently, pinning may be performed by a printer substantially at the same time as printing the ink, without requiring high-power UV radiation sources. A further benefit of ink pinning is that it prevents degradation of a printed image caused by bleeding, mixing, etc. of uncured inks on a substrate. Pinning thus significantly facilitates the handling of substrates having ink printed thereon (compared to non-pinned ink), thereby enabling an independent curing station, such as the curing station 100, to be used.

In one example, the height of the curing plate is constantly verified during the curing process to ensure that a predetermined height void is maintained. In this way irregular height substrates may be cured.

A yet further example of a curing station 600 will now be described with reference to FIG. 6.

The curing station 600 has a curing plate 602 that extends substantially over the whole of the substrate support 102 such that it extends over any substrate that may be loadable on the substrate support 102. One corner of the curing plate 602 is shown in FIG. 6 with a cut-out section. In one example the curing plate 602 is substantially sealable against the substrate support 102, for example using walls, such as walls 402, 406, 502, or 506 shown in FIGS. 4 and 5. For example, the curing plate 602 may have a first position at which a substrate 104 may be loaded onto the substrate support 102, and a second position at which the curing plate 602 is substantially sealed against the substrate support 102.

A UV radiation source 110 is mounted on a moveable carriage 604 such that it may be moved over the length of the substrate 104, and thus may cure ink placed anywhere on the substrate 104.

In one example, gas injectors (not shown) are mounted on the carriage 604 such that inert gas is introduced into the void between the curing plate 602 and the substrate 104 to generate a curing zone (not shown) substantially underneath the UV radiation source 110.

In a further example, gas injectors (not shown) are mounted at multiple locations around one or multiple edges of the curing plate 602, such that the oxygen level in substantially the whole void under the curing plate 602 is sufficiently depleted in oxygen to enable curing of ink on a substrate 104 to be performed. Where the curing plate is substantially sealed with the substrate support 102, a slight positive pressure of inert gas may be maintained in the void 108, thereby helping to maintain the oxygen-depleted atmosphere in the void 108 during the curing process.

In a yet further example, the curing station 600, creating a void 108 that is substantially sealed to the atmosphere, may deplete the oxygen level in the void to a suitable level through use of a vacuum pump (not shown). The curing of ink on the substrate 104 may be then be cured by the UV radiation source 110 in the manner described above.

In a still further example, a system 700 comprising a print writing system 702, an ink pinning system 703, and a curing station 704 is provided, as shown in FIG. 7. The print writing system 702 generates prints using UV curable inks, for example using ink jet printheads and UV inks. The ink pinning system 703 is provided to partially cure or pin printed ink using an in-line curing system. In one example the ink pinning system may use high-power UV radiation to pin the ink. In a further example the ink pinning system may pin the ink in an oxygen-reduced environment using low-power UV radiation.

A substrate ejected by the print writing system 702 and ink pinning system 703, and having pinned ink thereon, is fed to the curing station 704 where the pinned ink on the substrate is cured, for example using a curing system such as described herein.

One advantage of examples of the curing station as described herein is that the amount of inert gas needed to cure ink on a substrate is substantially reduced compared to performing curing in an inert environment in an existing printing system. This is achieved, as described herein, by creating a small void between a curing plate and a substrate, by reducing the oxygen content of the void, and by emitting UV radiation through the curing plate. Accordingly, this reduces the danger posed by having large amounts of inert gas in proximity to human operators.

A further advantage is that due to the final curing being performed in an oxygen-depleted environment, the amount of UV power to perform the curing is considerably lower than performing the curing in an oxygen-rich environment. Accordingly, the UV radiation sources used for the final curing may be low-power type sources, such as UV light emitting diodes (LEDs) or compact fluorescent UV bulbs.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings), may be replaced by alternative features serving the same, equivalent or similar purpose, unless expressly stated otherwise. Thus, unless expressly stated otherwise, each feature disclosed is one example only of a generic series of equivalent or similar features.

The invention claimed is:

1. An apparatus for curing ink on a substrate, comprising:
a substrate support;
a curing sheet positionable above the substrate support to create a gap between a substrate on the substrate support and the curing sheet, wherein the curing sheet covers a portion of the substrate on the substrate support and is mounted on a carriage by height adjustable walls connected to the edges of the curing sheet that are parallel to the longitudinal edge of the substrate support;
an oxygen-depletion mechanism for reducing the oxygen level in the gap; and
an ultra-violet, UV, radiation source to apply UV radiation through the curing sheet to a substrate on the substrate support.

2. The apparatus of claim 1, wherein the curing sheet is substantially transparent to UV radiation emitted from the UV radiation source.

3. The apparatus of claim 1, wherein the curing sheet is height adjustable to create a gap of a predetermined height.

4. The apparatus of claim 1, wherein the curing sheet covers only a portion of the substrate on the substrate support, wherein the carriage is movable along the length of the substrate support and on which are mounted the curing sheet and the UV radiation source, to enable UV ink on the whole of a substrate to be cured.

5. The apparatus of claim 4, wherein the oxygen-depletion mechanism comprises a gas injector for injecting an inert gas into the gap as the carriage is moved along the length of a substrate on the substrate support.

6. An apparatus for curing ink on a substrate, comprising:
a substrate support;
a curing sheet positionable above the substrate support to create a gap between a substrate on the substrate support and the curing sheet, wherein the curing sheet further comprises a flexible wall seal along a traversal edge of the curing sheet, the flexible wall seal to contact cured ink on a substrate and to form a substantial seal therewith;
an oxygen-depletion mechanism for reducing the oxygen level in the gap; and
an ultra-violet, UV, radiation source to apply UV radiation through the curing sheet to a substrate on the substrate support.

7. An apparatus for curing ink on a substrate, comprising:
a substrate support;
a curing sheet positionable above the substrate support to create a gap between a substrate on the substrate support and the curing sheet, wherein the curing sheet covers the entirety of a substrate on the substrate support, the apparatus further comprising a carriage movable along the length of the substrate support and on which is mounted the UV radiation source to enable UV ink on the whole of a substrate to be cured, and wherein the curing sheet further comprises curing sheet walls connected to each of the edges of the curing sheet and that are substantially sealable against the substrate support;

an oxygen-depletion mechanism for reducing the oxygen level in the gap; and an ultra-violet, UV, radiation source to apply UV radiation through the curing sheet to a substrate on the substrate support.

8. The apparatus of claim 7, wherein the oxygen-depletion mechanism comprises a vacuum pump for removing air from the gap.

9. The apparatus of claim 7, wherein the oxygen-depletion mechanism comprises a gas injector for injecting an inert gas into the gap.

10. The apparatus of claim 1, wherein the UV radiation source is to emit UV radiation once the oxygen level of the gap has reached a predetermined level that is below 10%.

11. The apparatus of claim 6, wherein the curing sheet is height adjustable to create a gap of a predetermined height.

12. The apparatus of claim 6, wherein the curing sheet covers only a portion of the substrate on the substrate support, the apparatus further comprising a carriage movable along the length of the substrate support and on which are mounted the curing sheet and the UV radiation source, to enable UV ink on the whole of a substrate to be cured.

13. The apparatus of claim 6, wherein the UV radiation source is to emit UV radiation once the oxygen level of the gap has reached a predetermined level that is below 10%.

14. The apparatus of claim 7, wherein the curing sheet is height adjustable to create a gap of a predetermined height.

15. The apparatus of claim 7, wherein the UV radiation source is to emit UV radiation once the oxygen level of the gap has reached a predetermined level that is below 10%.

* * * * *